US006409129B1

(12) United States Patent
Chen et al.

(10) Patent No.: US 6,409,129 B1
(45) Date of Patent: Jun. 25, 2002

(54) FIXING DEVICE FOR SETTING ANTI-SHOCK FOOT STAND

(75) Inventors: Jun-Ming Chen, Tai-Nan; Chin-Jen Chen, Chang-Hua Hsien, both of (TW)

(73) Assignee: Silicon Integrated Systems Corporation, Hsinchu (TW)

( * ) Notice: Subject to any disclaimer, the term of this patent is extended or adjusted under 35 U.S.C. 154(b) by 0 days.

(21) Appl. No.: 09/654,228

(22) Filed: Sep. 2, 2000

(51) Int. Cl.[7] ..... A47B 91/00
(52) U.S. Cl. ..... 248/188.8; 248/677
(58) Field of Search ..... 248/188.8, 188.9, 248/188, 677, 638; 52/167.8

(56) References Cited

U.S. PATENT DOCUMENTS 5,308,036 A * 5/1994 Olson et al. ..... 248/638
6,123,300 A * 9/2000 Chen ..... 248/188.8
6,216,991 B1 * 4/2001 Okamoto ..... 248/188.1

* cited by examiner

*Primary Examiner*—Ramon O. Ramirez

(57) ABSTRACT

A fixing device for setting anti-shock foot stand comprises a casing and a positioning seat, wherein a deck and a shed connected therewith are housed in the casing; an inner space is available in the shed; at least a slot is formed in a ceiling of the shed, and one end of the slot is extended to reach an edge of the ceiling; a plurality of tapped holes and through holes are disposed in the ceiling and in two lateral walls of the shed respectively; a plurality of through holes is arranged in the deck; and at least a tapped hole and a plurality of tapped holes are disposed in a ceiling and in two lateral walls of the positioning seat respectively at positions corresponding to those lateral through holes of the shed. When assembling, the foot stand is firstly placed in the slot, then the shed and the positioning seat are edge jointed together and locked with bolts.

3 Claims, 6 Drawing Sheets

FIXING DEVICE FOR SETTING ANTI-SHOCK FOOT STAND

BACKGROUND OF THE INVENTION

1. Field of the Invention

This invention relates generally to a fixing device for setting anti-shock foot stand, more particularly, it relates to a fixing device that can position and set an anti-shock foot stand more stably both in horizontal and vertical direction.

2. Description of the Prior Art

In installation of machinery, fixing devices are usually required for setting a machine's foot stand for preventing any possible displacement of the machine, which may be incurred by one reason or another.

A conventional fixing device shown in FIG. 6 comprises a constraining pedestal A with a slot A1 disposed therein. When installing the fixing device onto a machine's foot stand, the procedure is to: turn firstly a nut B on a foot stud of a foot stand C to move upwardly; then place the foot stud in the slot A1; lock the nut B to prop against the constraining pedestal A for fixedly jointing the foot stand C with the constrain pedestal A. However, such a fixing assembly cannot effectively prevent the foot stand C from displacing along the slot A1 horizontally when the machine is shocked or quaked.

In view of abovesaid imperfection, this invention is to propose an improved fixing device that is capable of setting a foot stand firmly and stably as to be described below.

SUMMARY OF THE INVENTION

The primary object of this invention is to provide a fixing device for setting anti-shock foot stand, wherein two component sets of the fixing device are assembled on each foot of the foot stand to ensure stability of the foot stand without horizontal or vertical displacement thereof.

In order to realize abovesaid object, a fixing device of this invention for an anti-shock foot stand comprises a casing and a positioning seat, wherein a deck and a shed connected therewith are housed in the casing; an inner space is available in the shed; at least a slot is formed in a ceiling of the shed, and one end of the slot is extended to reach an edge of the ceiling; a plurality of tapped holes and through holes are disposed in the ceiling and in two lateral walls of the shed respectively; a plurality of through holes is arranged in the deck; and at least a tapped hole and a plurality of tapped holes are disposed in a ceiling and in two lateral walls of the positioning seat respectively at positions corresponding to those lateral through holes of the shed. When assembling, the foot stand is firstly placed in the slot, then the shed and the positioning seat are edge-jointed together and locked with bolts.

For more detailed information regarding this invention together with further advantages or features thereof, at least an example of preferred embodiment will be elucidated below with reference to the annexed drawings.

BRIEF DESCRIPTION OF THE DRAWINGS

The related drawings in connection with the detailed description of this invention, which is to be made later, are described briefly as follows, in which.

DETAILED DESCRIPTION OF THE PREFERRED EMBODIMENT

Figure 1:
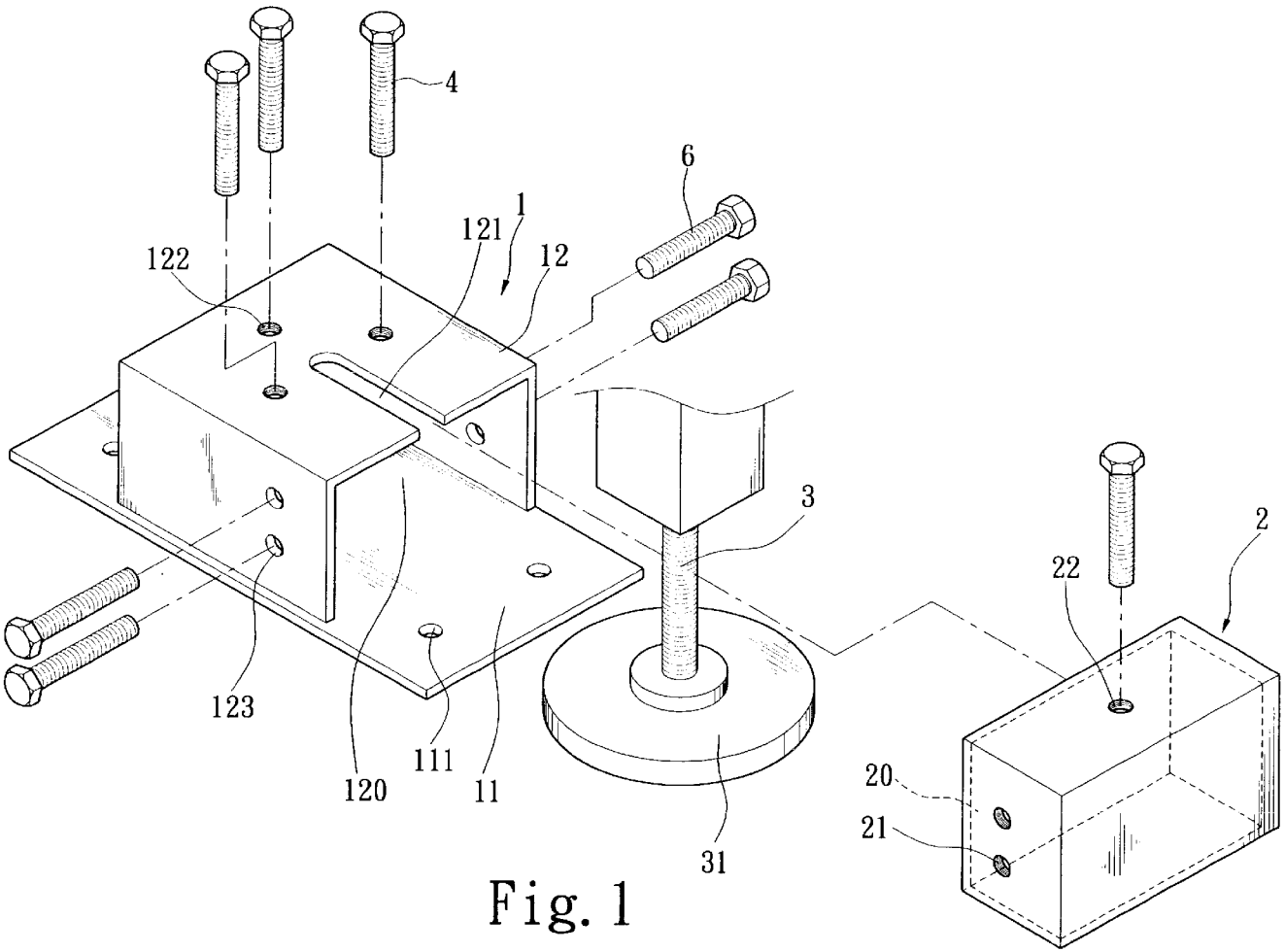
FIG. 1 is an exploded view in three dimensions showing assembling relationship between respective components and a foot stand of this invention.

A fixing device for setting anti-shock foot stand of this invention shown in FIG. 1 comprises a casing 1 and a positioning seat 2, wherein the casing 1 further comprises a deck 11 and a shed 12 built thereon, wherein a plurality of through holes 111 is arranged in the deck 11 and an inner space 120 is available in the shed 12; at least a slot 121 is formed in a ceiling of the shed 12, and one end of the slot 121 is extended to reach an edge of the ceiling; and a plurality of tapped holes 122 and through holes 123 are perforated in the ceiling and two lateral walls of the shed 12 respectively. Moreover, in the positioning seat 2, at least a tapped hole 22 and a plurality of tapped holes 21 are disposed in a ceiling and in two lateral walls of the positioning seat 2 respectively at positions corresponding to those lateral through holes 123 of the shed 12. In an embodiment of this invention, a recessed portion 20 available in the positioning seat 2 is relatively wider than the shed 12 to allow the latter to be partly invested by the former along a direction defined by an opening of the inner space 120 in the shed 12.

Figure 2:
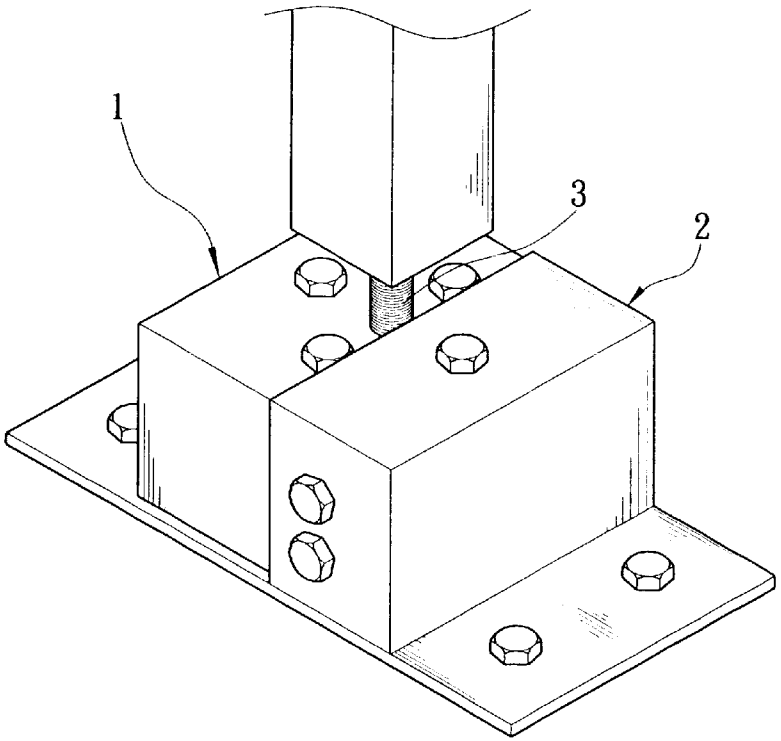
FIG. 2 is a prespective schematic view of this invention after the components shown in FIG. 1 are assembled.
Figure 3:
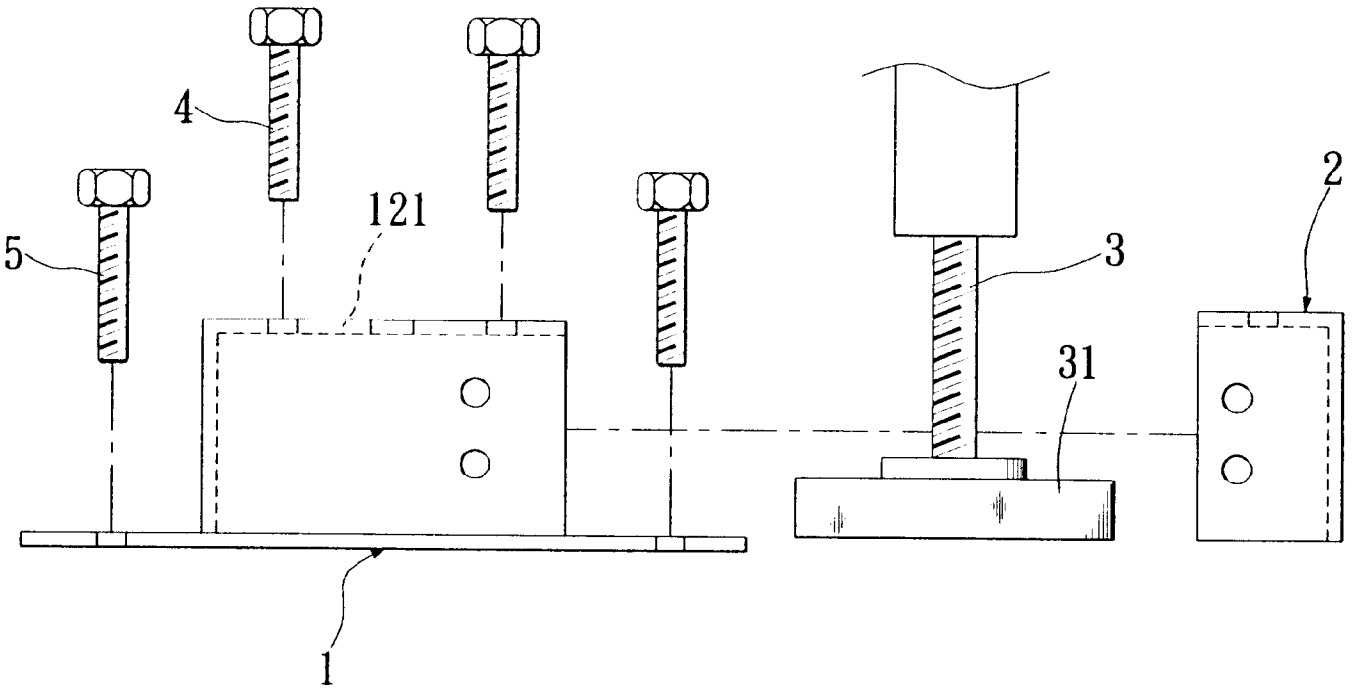
FIG. 3 is a cutaway sectional view illustrating assembling relationship between the components of this invention and the foot stand.
Figure 4:
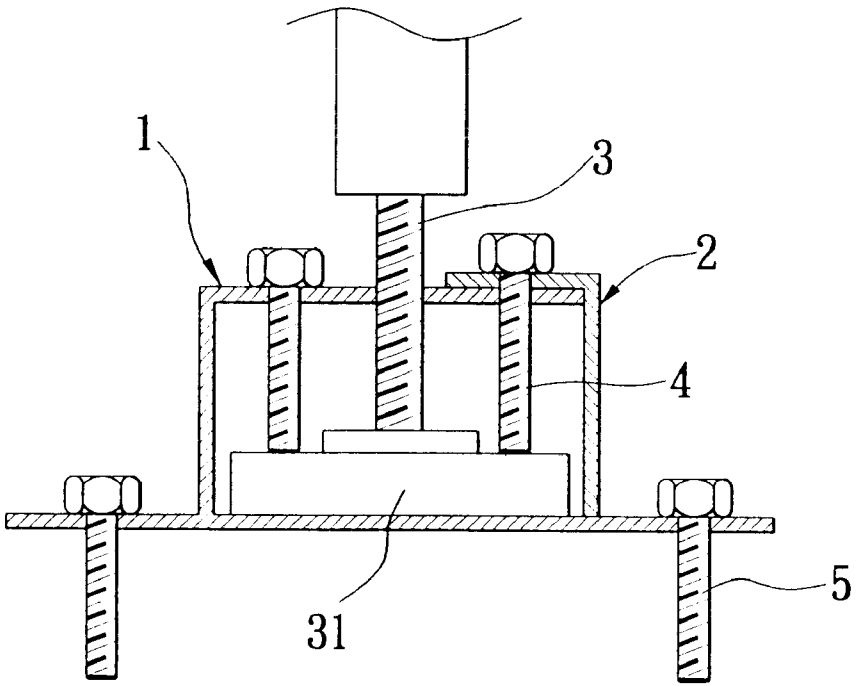
FIG. 4 is a cutaway sectional view illustrating assembled structure of the components in FIG. 3.

As illustrated in FIG. 1 and FIG. 3, in assembling this invention to a foot stand 3 of a machine, the procedure is to: place a vertical threaded foot of the foot stand 3 in the slot 121 of the shed 12 to meanwhile have a base 31 of the foot stand 3 accommodated in the inner space 120 of the shed 12; then, have the recessed portion 20 of the positioning seat 2 clad on the walls of the inner space 120; penetrate the lateral through holes 123 of the shed 12 with a plurality of bolts 6 and lock them in the lateral tapped holes 21 of the positioning seat 2 respectively to combine the positioning seat 2 together with the shed 12; moreover, lock a plurality of bolts 4 in the tapped holes 122 of the shed 12 and in the tapped hole 22 of the positioning seat 2 to have the lower end of the bolts 4 propped against a top face of the base 31 so as to fix the base 31 on the deck 11; and finally, penetrate the through holes 111 in the deck 11 with a plurality of bolts 5 (shown in FIG. 3) and lock them in predetermined tapped holes in the ground to have the assembling job completed as shown in FIG. 2 and FIG. 4. By now, the foot stand 3 is limited on the deck 11 between the shed 12 and an edge of the positioning seat 2, and the base 31 is constrained by the bolts 4, the foot stand 3 is thoroughly bound to refrain from displacing horizontally or vertically.

Figure 5:
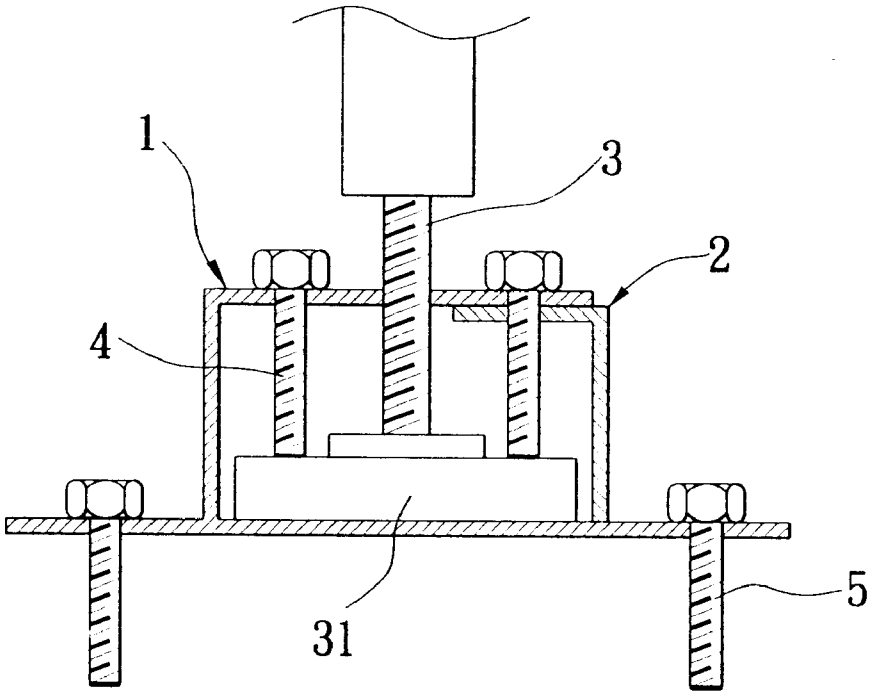
FIG. 5 is a cutaway sectional view illustrating structure of another embodiment of this invention.
Figure 6:
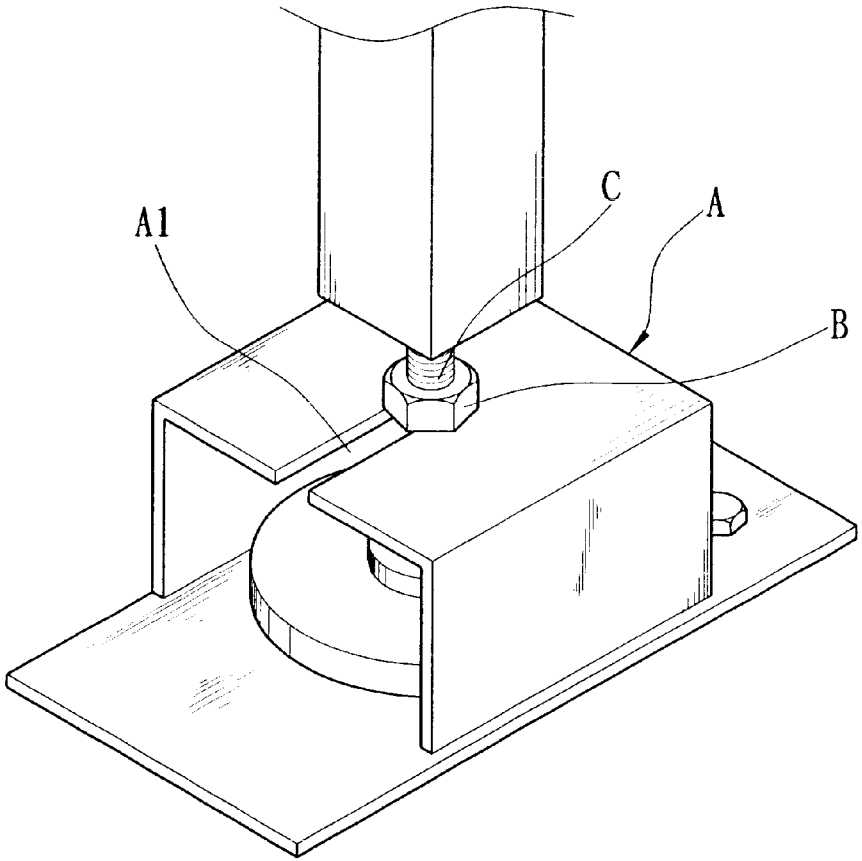
Fig. 6 Prior Art
FIG. 6 is a structural view in three dimensions showing a conventional fixing device for setting an anti-shock foot stand.

In another embodiment of this invention shown in FIG. 5, the rest is about the same with the abovesaid except that the positioning seat 2 is designed narrower than that of the inner space 120 of the shed 12 so as to allow the latter to partly cover the former.

Although, this invention has been described in terms of preferred embodiments, it is apparent that numerous variations and modifications may be made without departing from the true spirit and scope thereof, as set forth in the following claims.

What is claimed is:

1. A fixing device for setting anti-shock foot stand, comprising:

a casing having a shed housed on a deck, wherein an inner space is available in the shed; at least a slot is formed in a ceiling of the shed; one end of the slot is extended to reach an edge of the ceiling; a plurality of tapped holes and through holes are disposed in the ceiling and two lateral walls of the shed respectively; and a plurality of through holes is perforated in the deck; and a positioning seat having at least a tapped hole and a plurality of tapped holes disposed in a ceiling and in two lateral walls thereof respectively at positions corresponding to those lateral through holes in the shed;

wherein the positioning seat is coupled to the casing by means of a plurality of bolts locked in the tapped holes of the two lateral walls of the positioning seat and penetrating through the corresponding through holes of the two lateral walls of the shed.

2. The fixing device according to claim 1, wherein a recessed portion is formed in the positioning seat, and the width of the recessed portion is wider than that of the shed to allow the shed to be partly invested in the recessed portion of the positioning seat along a direction defined by an opening of the inner space in the shed.

3. The fixing device according to claim 1, wherein the width of the positioning seat is narrower than that of the inner space of the shed to allow the latter to partly cover the former.

* * * * *